United States Patent [19]

Mujahid et al.

[11] Patent Number: 4,755,712

[45] Date of Patent: Jul. 5, 1988

[54] MOLYBDENUM BASE ALLOY AND LEAD-IN WIRE MADE THEREFROM

[75] Inventors: Mohammad Mujahid, Little Rock, Ark.; Richard Conrad, Bricktown, N.J.

[73] Assignee: North American Philips Corp., New York, N.Y.

[21] Appl. No.: 939,585

[22] Filed: Dec. 9, 1986

[51] Int. Cl.[4] ..... C22C 27/04; H01K 1/38

[52] U.S. Cl. ..... 313/331; 313/332; 420/416; 420/429; 174/50.64; 252/521; 75/230; 75/244

[58] Field of Search ..... 420/429, 416; 428/614; 501/96, 98, 126; 252/518, 521; 313/331, 332; 75/230, 244; 174/50.64

[56] References Cited

U.S. PATENT DOCUMENTS

| | | | |
|---|---|---|---|
| 2,144,250 | 1/1939 | Allen et al. | 420/429 X |
| 4,254,300 | 3/1981 | Thompson-Russell | 313/331 X |
| 4,370,299 | 1/1983 | Morozumi | 420/429 |
| 4,419,602 | 12/1983 | Mitamura et al. | 313/332 |

FOREIGN PATENT DOCUMENTS

| | | | |
|---|---|---|---|
| 976095 | 11/1964 | United Kingdom | 420/429 |
| 415118 | 2/1975 | U.S.S.R. | 420/429 |
| 489801 | 10/1975 | U.S.S.R. | 420/429 |

*Primary Examiner*—David K. Moore
*Assistant Examiner*—Mark R. Powell
*Attorney, Agent, or Firm*—Norman N. Spain

[57] ABSTRACT

A lead-in wire for use in an election lamp formed of molybdenum (undoped or doped with small amount of potassium and silicon) containing small amount of yttrium oxide and molybdenum boride is disclosed.

8 Claims, 1 Drawing Sheet

MOLYBDENUM BASE ALLOY AND LEAD-IN WIRE MADE THEREFROM

BACKGROUND OF THE INVENTION

The instant invention relates to molybdenum base alloys and to wires made from such alloys which wires are particularly useful as lead-in wires for use in glass quartz envelopes of electric light or lamps.

The use of molybdenum wire as lead-in wires for conducting current through a pinch seal of a glass or quartz envelope of an electric lamp is well known and frequently employed.

Thus, in Hardies, U.S. Pat. No. 4,015,165, molybdenum end wires (or outer current conductors) are employed to conduct current through a pinch seal to an molybdenum foil incorporated in the pinch seal to a current conductor provided within a glass or quartz envelope of an electric lamp.

Patrician et al, U.S. Pat. No. 4,322,248, shows a wire formed of an an alloy of molybdenum containing about 2 to 6% by weight of tantalum (as a gettering agent) and from about 50 to 1,000 parts per million by weight of silicon and about 50 to about 1,000 parts per weight of potassium as dopants. This Patrician et al patent teaches that the wires disclosed therein are useful as lead-in wires for conducting electricity into pinch seals of glass or quartz envelopes generally employed in electric lamps and as in particularly in halogen incandescent lamps.

The use of undoped molybdenum lead-in wires for conducting current through a pinch seal in a tungsten halide electric incandescent lamp is also shown in Van Dar Linden et al U.S. Pat. No. 3,538,373.

Similarly use is for molybdenum wires and foil is disclosed in Huyskens U.S. Pat. No. 3,736,454. Additionally, the use of molybdenum lead-in wires and foil conducting current through pinch seals in high pressure discharge lamps shown in U.S. Pat. Nos. 3,953,755, to Kuus et al; 4,539,509, to Varshneya; 4,389,201 to Hunsler et al and 4,302,699 to Keefe et al.

A problem with these molybdenum wires generally employed for lead-in wires is that they have a relatively low recrystallization temperatures. Thus a molybdenum wire (for example 30 mil diameter mandrel grade molybdenum wire) at 1100° C. produces a completely recrystallized equiaxis grain structure resulting in a substantial loss in room temperature tensile strength. This loss in room temperature tensile strength increases significantly with increasing flashing temperature.

It is known that doping molybdenum with potassium and silicon to produce MOD grade molybdenum increases the recrystallization temperature to about 1650° C. along with the formation of course elongated grain. As a result the MOD grade wire made from MOD grade molybdenum exhibits a substantially improved room temperature tensile strength and shows improved strength both at high and low temperatures in pinch seal applications in electric lamps.

However the production of the K-Si doped molybdenum is relatively time consuming and expensive. Thus, the method generally employed involves, slurry doping of molybdenum with the oxide of silicon and potassium, subjecting the powder to a two stage reduction including sintering in hydrogen, and pulverizing. Then the ingots are pressed and sintered and are then swaged and wire drawn.

SUMMARY OF THE INVENTION

A principal object of the invention is to provide an molybdenum base alloy that is easier to produce than potassium and silicon doped molybdenum while exhibiting comparable improved properties.

Another object of the invention is to provide a silicon and potassium doped molybdenum alloy of significantly improved properties.

Still another object of the invention is to provide improved lead-in wire particularly adapted for press seal application in electric lamps.

According to one aspect of the invention, a novel molybdenum base alloy consisting essentially of molybdenum, yttrium trioxide ($Y_2O_3$) in an amount up to about 2% by weight and molybdenum boride in an amount up to about 0.8% by weight is produced.

This alloy which is much easier to produce than the K-Si doped molybdenum exhibits an increase in recrystallization temperature and an improvement in the room temperature tensile strength of wire produced from the alloy that is comparable with that achieved with the K-Si doped molybdenum alloy.

According to another aspect of the invention a novel Si molybdenum base alloy consisting essentially of molybdenum doped with potassium and silicon and containing in addition yttrium trioxide in an amount up to about 2.0% by weight and molybdenum boride in an amount up to about 0.8% by weight. This Si alloy exhibits an increase in the recrystallization temperatures and an improvement in the room temperature tensile strength of wire produced therefrom as compared to the known K-Si doped molybdenum.

According to other aspects of the invention there are provided electric lamps having light transmissive envelopes in which lead-in wires which are connected into pinch seals are formed of novel molybdenum base alloy wires of the invention.

BRIEF DESCRIPTION OF THE DRAWING

The sole FIGURE in the drawing is a view partly in cross-section of one end of a lamp provided with a lead-in wire of the invention.

DETAILED DESCRIPTION OF THE INVENTION

Figure 1:
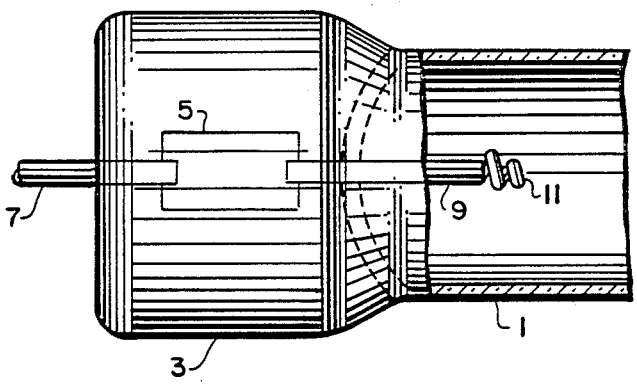

According to one aspect of the invention while alloy compositions consisting essentially of molybdenum with up to 2 weight percent $Y_2O_3$ and up to 0.8 weight percent of MoB is found that best results are achieved when the concentration of the $Y_2O_3$ is from 0.1–2.0 weight percent and concentration of the MoB is from 0.01–0.08.

Preferably the potassium silicon doped molybdenum contains 70–100 parts of potassium and 30–150 parts per million of silicon. According to the invention, the doped molybdenum alloy preferably contains 0.1–2.0 weight percent $Y_2O_3$ and 0.01–0.08 weight percent MoB.

The invention will now be described in greater detail with reference to the following examples and to the drawing, the sole FIGURE of which is a view partially in cross-section of one end of the lamp employing a lead-in wire of the invention.

EXAMPLE 1

Undoped molybdenum powder was blended with 1.0 weight percent $Y_2O_3$ and 0.2 weight percent MoB.

Ingots were pressed from this mixture and from undoped mandrel molybdenum. After sintering at 1985° C. for 9 hours, the ingots were swaged and drawn to 0.030" wire. The bending properties of the resultant wires were compared by flashing the wires in nitrogen for 15 seconds. The results of these tests are shown in the following table 1.

TABLE I

| Temperature of Flash °C., 15 sec. in $N_2$ | Bending Properties - 20° Bends | |
|---|---|---|
| | Molybdenum Alloys | Undoped Mandrel Molybdenum |
| 1630° C. | 18 | 1 |
| 1740° C. | 7 | 0 |
| 1860° C. | 4 | 0 |

The microstructure of the disclosed alloy showed predominantly small equiaxed grains with some tendency toward the formation of elongated grains. Undoped mandrel molybdenum showed at 1630° C. large equiaxed grains. The bending properties of wires produced from these alloys of our invention were surprising in view of the fact that blending molybdenum with similar amounts of aluminum oxide or thorium oxide and flashing the resultant wires in nitrogen for 15 seconds at 1630° C. produces very poor results, 0 or 1 bends.

While the alloys of this aspect of our invention are not as good as K-Si doped alloys, they are quite useful for quartz press seal applications and they have the advantage of being produced in a much less expensive manner. A two-stage reduction in hydrogen, which is required before sintering, for a production of the K-Si doped molybdenum is not required for the production of the molybdenum alloy of this aspect of the invention.

EXAMPLE 2

Molybdenum that has been doped with 78 parts per million of of K and 110 parts per million of Si were blended with 0.5 weight percent $Y_2O_3$ and 0.1 weight percent MoB. Ingots pressed from this powder and the ingots were sintered at 1985° C. for nine hours. A density of 9.42 gm/CC was obtained. These ingots were then swaged and drawn to 0.030" wire.

Comparison of the microstructure of molybdenum doped with amounts of K and Si and with this alloy at 1740° C. for a 15 second flash showed that the K-Si doped molybdenum was completely recrystallized and showed elongated grains while the alloy exhibited mostly fiber structure.

The following values of the ultimate tensile strength (UTS) were obtained after flashing the wires for 15 seconds in nitrogen and then testing the tensile strength at room temperature.

TABLE II

| Temperature °C. | UTS K—Si + Y O + MoB | UTS K—Si doped |
|---|---|---|
| 1500 | 102 | 107 |
| 1600 | 101 | 102 |
| 1700 | 93 | 72 |

As shown in this table the addition of $Y_2O_3$ and MoB to K-Si doped molybdenum improved the properties of the K-Si doped molybdenum particularly at 1700° C. As a result of its improved tensile strength at high temperatures the $Y_2O_3$ and MoB modified K-Si doped molybdenum alloy of the invention is particularly suitable for use as lead-in wires for sealing by pinch seals in quartz or hard glass envelopes of electric lamps, particularly high intensity discharge lamps.

This alloy is particularly useful for such a purpose since in addition to the improved tensile strength wires formed from thin alloy may be subjected to many bends without damage after flashing at temperature of 1630° C., 1740° C. and 1860° C.

An example of an application of the use of a wire found from an alloy of the invention is shown in the sole FIGURE of the drawing which is a view partly in cross-section of and end of a lamp provided with a lead-in wire of the invention.

As shown in the drawing, the cylindrical wall 1 of a quartz envelope of an electric lamp is provided with and seal 3 enclosing a foil of molybdenum 5. A wire 7 formed from a molybdenum alloy of the invention is sealed to one end of the foil 5 and which extends out of the envelope functions as a lead-in or current supply wire. A wire 9 formed from a molybdenum alloy of the invention or tungsten secured to the opposite side of the foil 5 supplies current to the thermally emitting electrode 11 formed of tungsten and situated within the envelope of the lamp.

Having thus described the invention, it will be apparent to those skilled in the art that various modifications can be made without departing from the spirit and scope of the present invention.

What we claim is:

1. A molybdenum base alloy particularly adapted for the production of lead-in wires for use in lamps, said alloy consisting essentially of molybdenum, 0.01–2% by weight of yttrium trioxide and 0.01–0.8% by weight of molybdenum boride.

2. A molybdenum base alloy particularly adapted for the production of lead-in wires for use in lamps, said alloy consisting essentially of molybdenum doped with 70–100 parts per million by weight of potassium and 30–50 parts per million by weight of silicon, 0.1–2.0% by weight of yttrium trioxide ($Y_2O_3$) and 0.01–0.8% by weight of molybdenum boride (MoB).

3. A lead-in wire for use in lamps, said wire being formed of the alloy of claim 1.

4. A lead-in wire for use in lamps, said wire being formed of the alloy of claim 2.

5. An electric lamp comprising a light-transmissive envelope, said envelope being provided with a light-transmissive wall portion, a pinch seal and a lead-in wire extending from said pinch seal away from said envelope, said lead-in wire being a molybdenum base alloy consisting essentially of molybdenum, 0.01–2% by weight of yttrium trioxide ($Y_2O_3$) and 0.01–0.8% by weight of molybdenum boride (MoB).

6. An electric lamp comprising a light transmissive envelope lamp, said envelope being provided with a light-transmissive wall portion, a pinch seal and a lead-in wire extending from said pinch seal away from said envelope, said lead-in wire being a molybdenum base alloy consisting essentially of molybdenum doped with 70–100 parts by weight of potassium and 30–150 parts by weight of silicon, 0.1–0.2% by weight of yttrium trioxide ($Y_2O_3$) and 0.01–0.8% by weight of molybdenum boride ($M_oB$).

7. The electric lamp of claim 5 wherein the light-transmissive wall portion is formed of quartz.

8. The electric lamp of claim 6 wherein the light-transmissive wall portion is formed of quartz.

* * * * *